United States Patent [19]

Ulrich et al.

[11] Patent Number: 4,525,980

[45] Date of Patent: Jul. 2, 1985

[54] APPARATUS FOR SEALING CARTONS

[75] Inventors: Lawrence W. Ulrich, Cicero; Connie W. Walker, Bolingbrook, both of Ill.

[73] Assignee: Durable Packaging Corporation, Chicago, Ill.

[21] Appl. No.: 486,258

[22] Filed: Apr. 18, 1983

[51] Int. Cl.[3] ..... B65B 7/20

[52] U.S. Cl. ..... 53/374; 53/76; 53/77; 53/491

[58] Field of Search ..... 53/374, 474, 75, 76, 53/77, 491

[56] References Cited

U.S. PATENT DOCUMENTS

| | | | |
|---|---|---|---|
| 3,302,367 | 2/1967 | Talarico | 53/374 |
| 3,374,604 | 3/1968 | Roesenor et al. | 53/75 |
| 4,044,527 | 8/1977 | Ulrich et al. | 53/76 |

*Primary Examiner*—Leonidas Vlachos

*Attorney, Agent, or Firm*—Dressler, Goldsmith, Shore, Sutker & Milnamow, Ltd.

[57] ABSTRACT

Apparatus for sealing the foldable flaps of cartons of random sizes by applying a self-adhesive tape material along the edges of the flaps having improved assemblies for automatically infolding the trailing minor flaps and for controlling the positioning of the flap folding assembly at or above the upper edge of the carton. The assembly for infolding the trailing minor flap includes a kicker arm assembly which incorporates a kicker arm member mounted for sliding longitudinally along a generally horizontal axis between an extended position and a retracted position. The assembly for controlling the positioning of the flap folding assembly includes a brake assembly for selectively retaining the flap folding assembly in a fixed position, a control means for controlling the brake assembly and an actuator assembly for activating the control means.

8 Claims, 5 Drawing Figures

121
123
120

2.
102
104
90
84
90
100
98
112
28
58
64
116
144
80
92
96
66
64
56
32
142
48
76
76
124
94
22
114
122
120
23
20
18
2.

46
92
80
84
112
90
116
144
142
48
64
28
32
148
66
82
90
147
146
140
130
130
126
118
134
136
100
128
60
44
72
74
76
58
20
23
160
162
164
152
16
166
14

APPARATUS FOR SEALING CARTONS

BACKGROUND OF THE INVENTION

The present invention relates to apparatus for sealing the foldable flaps of cartons of random sizes by applying a self-adhesive tape material along the edges of the flaps, and more particularly to improved assemblies for automatically infolding the top flaps prior to the application of the adhesvie material and for controlling the positioning of the flap folding assembly at or above the upper edge of the carton.

In the packaging industry, corrugated and fiberboard cartons have been used for many years and various machines have been developed which are capable of sealing such cartons either by gluing the flaps, taping the flaps, or by stapling or otherwise providing mechanical fasteners to maintain the flaps in a closed position. Many of these machines are designed to accept cartons of random width and height by providing various types of sensing means to control the transverse movement of the side arms associated therewith and the vertical movement of the top sealing head assembly. Examples of such machines are disclosed in U.S. Pat. Nos. 4,079,577 and 4,364,219, both of which have the same assignee as the present invention.

Although many of the heretofore known machines have operated quite satisfactorily under most operating conditions, in certain instances they have had difficulties in handling some of the cartons which have been fed thereinto for sealing. For example, the flap folding mechanisms of such machines have experienced difficulties in infolding a trailing top minor flap which is substantially beyond a vertical orientation. Various types of pivotally mounted kickers have been utilized to alleviate this problem, however, they have not totally solved the problem. Examples of such kickers are disclosed in U.S. Pat. Nos. 3,267,640 and 3,973,375. Another problem frequently encountered by heretofore known machines is the tendency to crush the end walls of cartons which are not completely filled, due to the forces applied by the sealing head assembly or flap folding assembly as it is lowered thereon during operation. In order to alleviate this problem it is necessary to accurately sense the top of the end walls and positively retain the sealing head assembly immediately thereabove without the application of crushing forces. It is also important that the machine operate rapidly to increase the utilization of the machine.

SUMMARY OF THE INVENTION

Briefly stated, the carton sealing apparatus in accordance with the present invention includes a frame structure, a sealing head assembly, a pair of facing side arm assemblies, and mechanisms to control the infolding of the top flaps and to vertically position the sealing head assembly. The frame structure defines a generally horizontal carton support bed for receipt and transport of the carton passed the sealing head assembly supported thereabove. The sealing head assembly is mounted to the frame structure to permit vertical positioning thereof relative to the carton support bed to accommodate cartons of various heights. The side arm assemblies are mounted to the frame structure in facing relationship so as to permit transverse movement thereof to accommodate cartons of various widths.

The structure for infolding the top flaps of the carton includes a plough member associated with the sealing head assembly to infold the leading minor flap and side plough members associated with the side arm assemblies to infold the major flaps. In accordance with one feature of the present invention a unique arrangement is provided for infolding the trailing minor flap. Such arrangement includes a kicker arm assembly which incorporates a kicker arm member mounted for sliding longitudinally along a generally horizontal axis between an extended position and a retracted position. The kicker arm member when in its extended position is located outwardly of the trailing minor flap of the carton and as it is moved towards its retracted position it contacts and infolds the trailing minor flap. The kicker arm member is secured to a kicker slide plate, which plate is secured for movement along a generally horizontal slide shaft. A kicker cylinder is secured to the slide plate to effect the movement thereof along the length of the slide shaft. The kicker arm member is formed with a generally horizontal lower surface which has an elevation slightly above the elevation of the upper edge of the trailing end wall when the sealing head assembly is in its sealing position above the carton.

Another feature of the present invention is the unique arrangement which positions and retains the flap folding assembly at or immediately above the upper edges of the end walls of the carton, without applying crushing forces to the end walls. Such arrangement includes a brake assembly for selectively retaining the flap folding assembly in a fixed position, a control means associated with the brake assembly which upon activation prevents downward movement of the flap folding assembly and an actuator assembly which actuates the control means at or immediately prior to the flap folding assembly contacting the upper edges of the end walls of the carton. The actuator assembly includes an actuator link member and an actuator pivot bar. The actuator link member is mounted for movement relative to the flap folding assembly between a first position which activates the control means and a second position which inactivates the control means. The actuator pivot bar is pivotally mounted about a generally horizontal axis to the actuator link through a pivot connection and is movable between a first generally horizontal position and a second inclined position. The actuator link and the actuator pivot bar are biased towards their respective second positions. When the actuator pivot bar contacts the upper edges of a carton it moves into its first position and the actuator link is moved into its first position, which in turn activates the control means and causes the brake assembly to retain the flap folding assembly in a fixed position at or immediately above the carton.

In accordance with a further feature of the invention, the brake assembly includes an air brake unit which cooperates with a brake bar in a manner which will be further discussed hereinbelow.

These and other features and advantages of the invention will become apparent by reference to the following detailed description taken in connection with the accompanying drawings.

DESCRIPTION OF A PREFERRED EMBODIMENT

Figure 1:
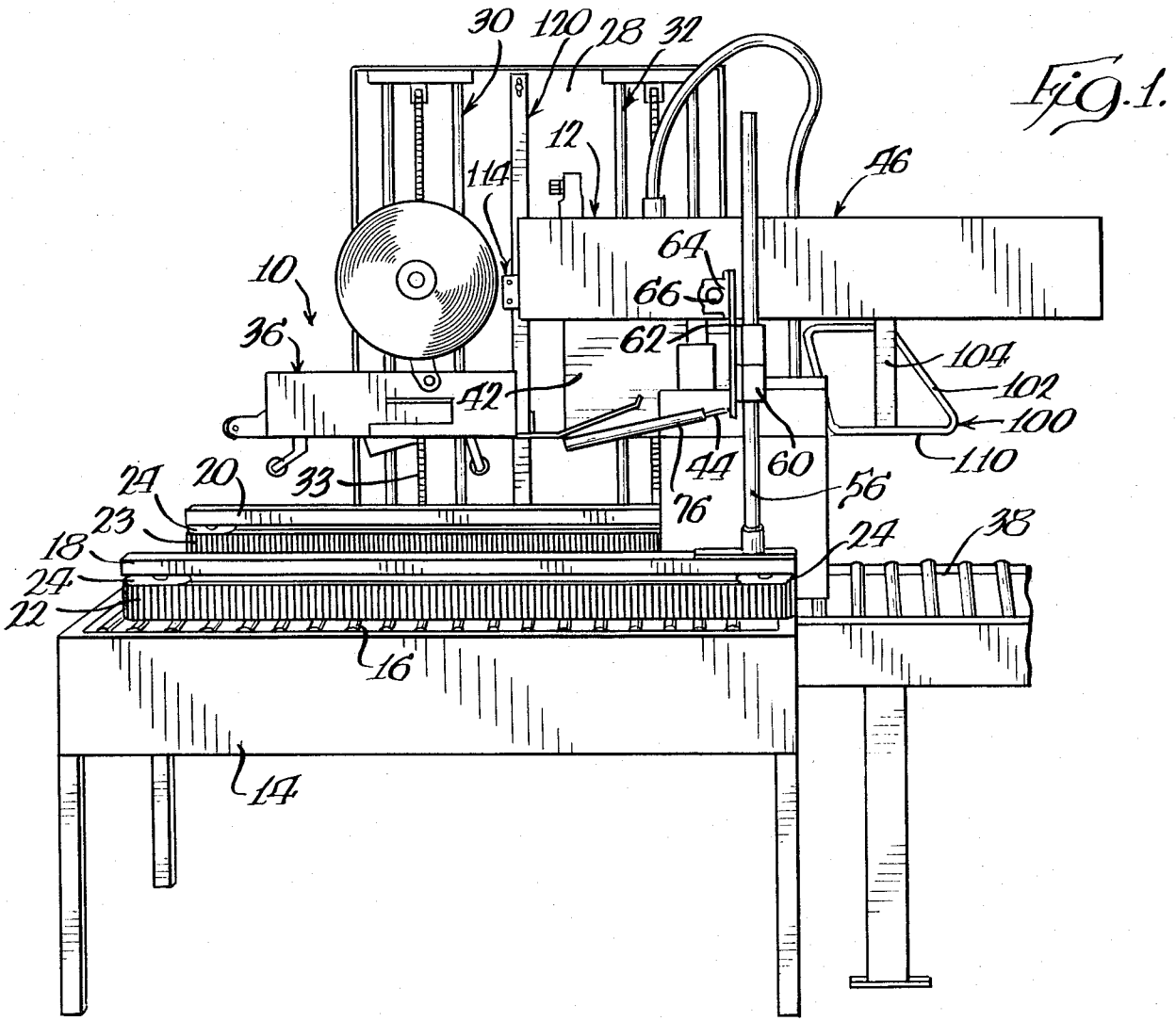
FIG. 1 is a perspective view of the carton sealing apparatus constructed in accordance with the present invention showing the flap folding assembly in a lowered position above a carton and the kicker assembly in an intermediate position about to infold the trailing minor flap.

Referring now in detail to the drawing and in particular to FIG. 1, a carton sealing apparatus incorporating the unique features of the present invention is indicated generally at 10. Carton sealing apparatus 10 is of the qeneral type specifically disclosed in coassigned U.S. Pat. No. 4,044,527. In order to keep the construction details of the carton sealing apparatus to a minimum, the disclosure of U.S. Pat. No. 4,044,527 is hereby incorporated by reference for such disclosure.

Carton sealing apparatus 10 includes a frame structure 14 for support of a plurality of longitudinally spaced carton conveying rollers 16 which define the carton support bed. A pair of transversely spaced and longitudinally extending side arm assemblies 18 and 20 are mounted to frame 14 above rollers 16. The side arm assemblies 18 and 20 are mounted so as to permit simultaneous transverse sliding movement towards and away from each other by pneumatic cylinders (not shown). Endless conveyor belts 22 and 23 are journaled around rollers 24. Extending vertically upward from frame 14 is a structural vertical lift housing 28. Positioned within housing 28 are a pair of vertical lift assemblies 30 and 32 which are powered by a single pneumatic cylinder 33. Lift assembly 30 is secured to tape head support assembly (not shown) and is effective to move the tape head assembly 36, associated therewith, up and down above the carton support bed defined by frame 14. Lift assembly 32 is secured to a flap folding mechanism 12. Lift assemblies 30 and 32 move up and down together along with the tape head support assembly and the flap folding mechanism 12 respectively associated therewith. The support assembly and folding mechanism 12 are rigidly secured to one another to effect such simultaneous movement. A powered infeed conveyor 38 may be provided to feed cartons onto the carton support bed of sealing apparatus 10 and a powered outfeed conveyor (not shown) may be provided to remove sealed cartons from sealing apparatus 10.

As alluded to hereinabove, one of the unique features of the present invention is directed to an improvement in the flap folding mechanism 12. The flap folding mechanism 12 of the present invention automatically infolds the top flaps of the carton and is of the general type disclosed in U.S. Pat. No. 4,079,577. In order to keep the construction details of the portion of the flap folding mechanism which does not interrelate with the present invention to a minimum, the disclosure of U.S. Pat. No. 4,079,577 is hereby incorporated by reference for such disclosure.

Flap folding mechanism 12 includes a plough arrangement 42 for infolding the leading minor flap, a pair of flap contacting arms 44 for infolding the respective major flaps, and a kicker assembly 46 for infolding the trailing minor flap. Extending transversely inwardly from lift assembly 32, and vertically movable therewith, is a support assembly 48. Plough arrangement 42 is rigidly secured to the underside of support assembly 48. Guide rods 56 and 58 extend respectively vertically upward from the upper forward surfaces of side arms 18 and 20. Mounted about each of the guide rods 56 and 58 is a bearing assembly 60 in a manner which permits same to move vertically up and down the respective rods. A connecting plate 62, having a bearing 64 associated therewith, is secured to each bearing assembly 60. A connecting rod 66 extends transversely through the respective bearings 64 so as to effect unison vertical movement of the bearing assemblies 60 to permit transverse movement of bearings 64. Connecting rod 66 is rigidly secured at an intermediate point to support assembly 48. Flap contacting arms 44 are secured to a respective bearing assembly 60. Contacting arms 44 include a transverse portion 72 which is secured to the bearing assembly and a longitudinal portion 74 which is bent to extend inwardly of the respective side arms 18 and 20. Portion 74 preferably extends slightly inwardly in the direction of movement of the carton to be sealed. Journaled for rotation about each longitudinal portion 74 is a roller member 76.

From the foregoing description of flap closing mechanism 12, it should be readily apparent that the vertical movement of support assembly 48 is effective to move plough mechanism 42 and arms 44 up and down therewith. Further, the transverse movement of side arms 18 and 20 is effective to move contacting arms 44 inward and outward therewith.

Figure 2:
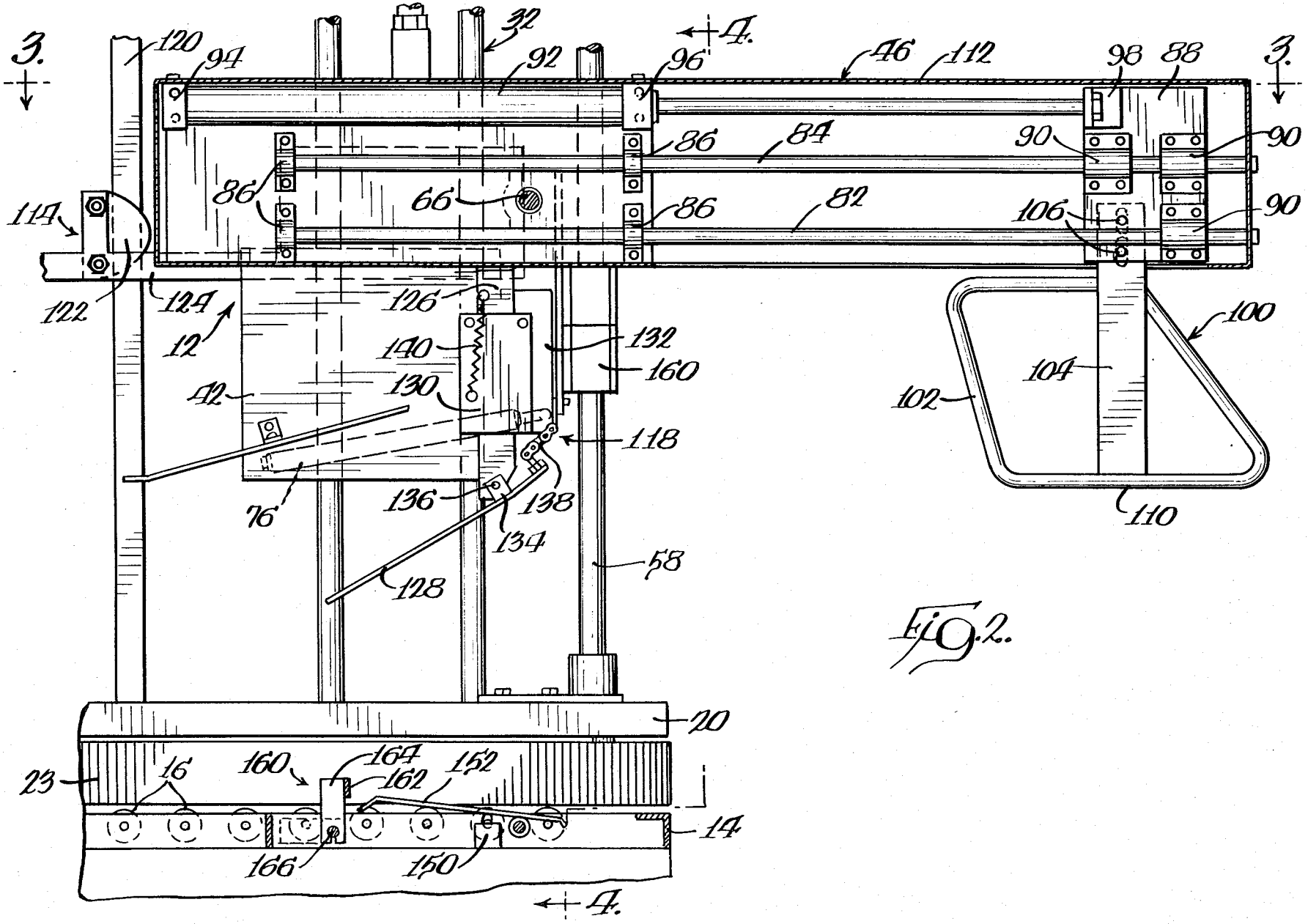
FIG. 2 is an enlarged vertical sectional view of a portion of the apparatus shown in FIG. 1, taken along the line 2—2 as indicated in FIG. 3, showing the kicker assembly in its extended position and the actuator pivot bar in its second position.

As best seen in FIG. 2, kicker assembly 46 is secured to the end of support assembly 48 and movable therewith. Kicker assembly 46 includes a mounting plate 80 which is suitably secured to support assembly 48. A pair of longitudinally extending generally horizontal shafts 82 and 84 are rigidly supported by shaft clamps 86 which in turn are secured to plate 80. The inner ends of shafts 82 and 84 terminate adjacent the forward end of sealing assembly 36, whereas the outer ends thereof extend outwardly beyond the forward end of frame assembly 14 over the infeed conveyor 38. Clamps 86 support the shafts 82 and 84 at their inner sections such that the outer section thereof are able to serve as guide members. A kicker slide plate 88 is slidably mounted to the outer sections of shafts 82 and 84. Bearings 90 are secured to plate 88 and receive the outer ends of shafts 82 and 84 therethrough so as to permit plate 88 to longitudinal slide along shafts 82 and 84. A pneumatic kicker cylinder 92 is suitably secured to plate 80 at the cylinder end thereof by supports 94 and 96 and to plate 88 at the rod end thereof by rod mount 98. The retraction and extension of the rod end of kicker cylinder 92 is effective to longitudinally move plate 88 respectively towards and away from the forward section of frame assembly 14. A kicker member 100 is secured to plate 88 and extends downwardly therefrom. Kicker member 100 is a shaped rod member 102 which is welded to a vertical bar 104. The upper end of bar 104 has a pair of vertical slots 106 formed therein which receive fasteners 108 therethrough to secure the kicker member 100 to plate 88. Member 102 is preferably formed with a generally horizontal lower surface 110, the elevation of which may be adjusted by selectively positioning fasteners 108 within slots 106. A kicker guard 112 is provided to house the assembly 46 and support the outer ends of shafts 82 and 84. Kicker guard 112 is secured to supports 94 and 96 and the forward end thereof is provided with openings to receive the forward ends of shafts 82 and 86 therethrough. The operation of kicker assembly 46 will be further discussed hereinbelow.

Figures 3, 5:
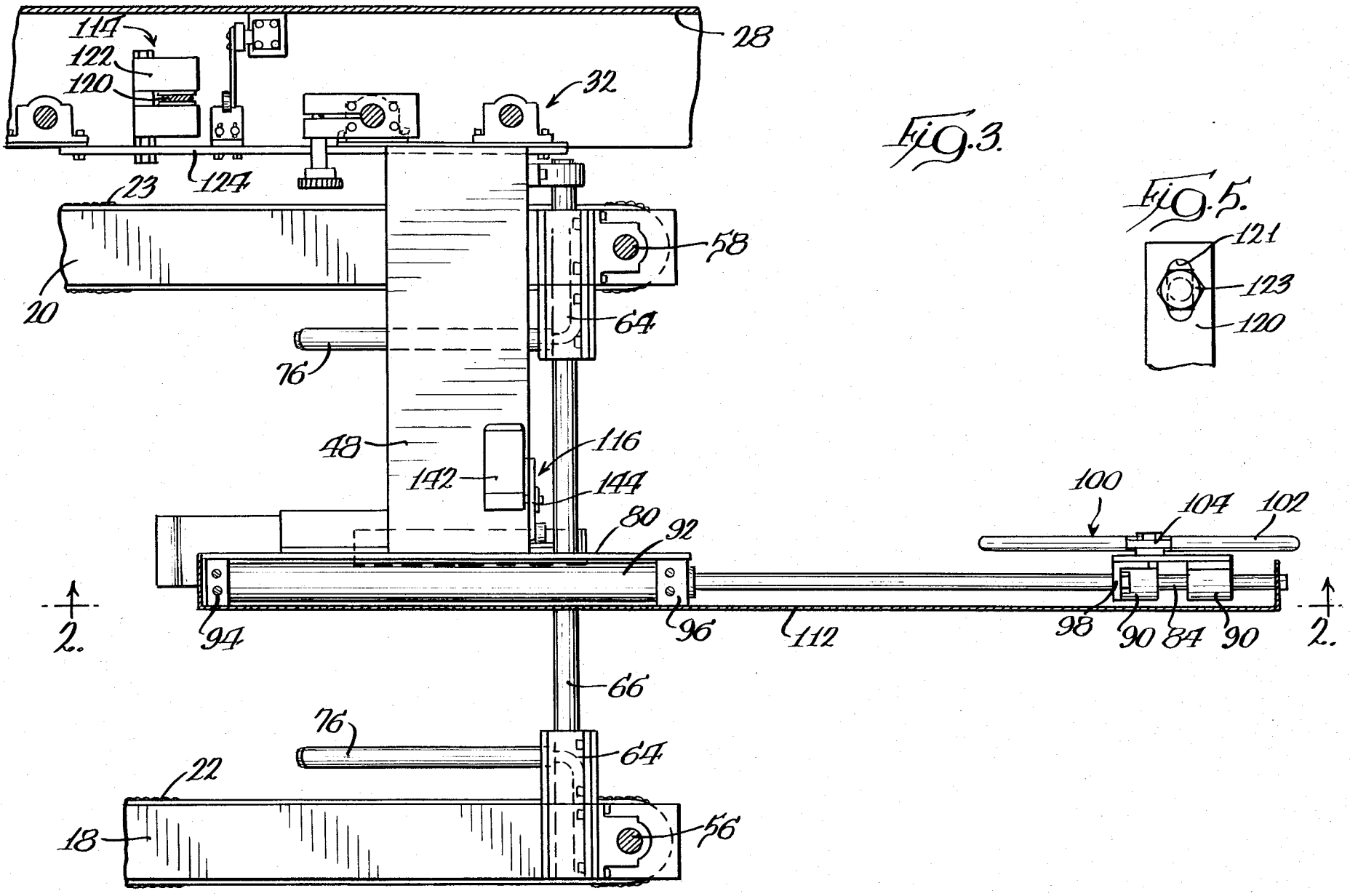
FIG. 3 is an enlarged horizontal sectional view of the portion of the apparatus shown in FIG. 2, taken along the line 3—3 as indicated in FIG. 2.
FIG. 5 is an enlarged fragmentary view of the connection of the brake bar to the lift housing.
Figure 4:
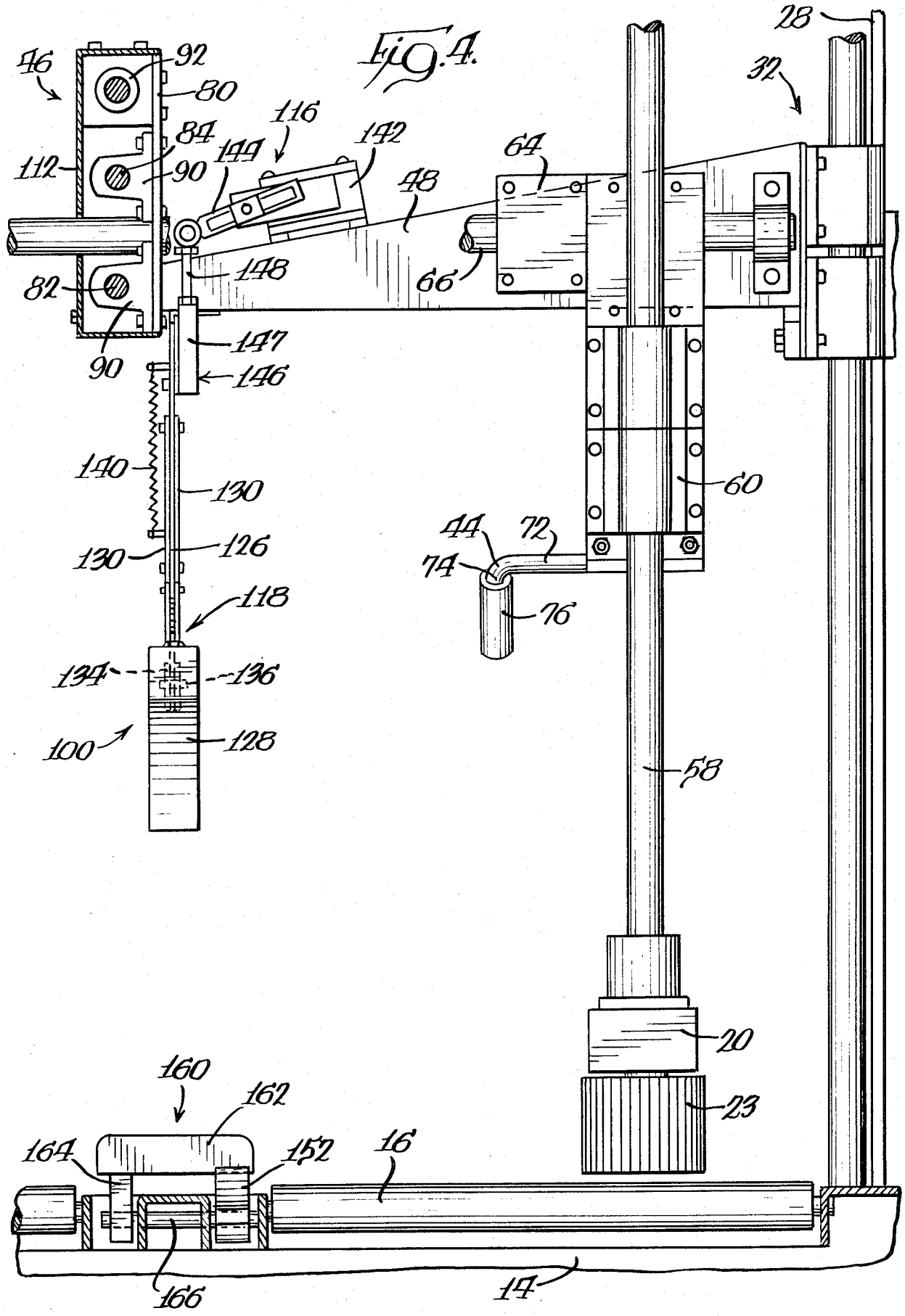
FIG. 4 is an enlarged sectional view, taken along the line 4—4 as indicated in FIG. 2.

As best seen in FIGS. 2–4, the arrangement which positions and retains the flap folding mechanism 12 and the sealing head assembly 36 at or immediately above the upper edges of the carton, without applying crushing forces to the end walls, will now be described. This arrangement includes a brake assembly 114 for selectively retaining the mechanism 12 and assembly 36 in a fixed position, a control means 116 for controlling brake assembly 114 and an actuator assembly 118 for activating the control means. The actuator assembly 118 senses the upper edge of the carton and actuates the control means 116, which in turn activates the brake assembly 114 and stops the downward movement of the mechanism 12 and assembly 36 at a preselected elevation at or immediately above the frame 14

Brake assembly 114 includes a vertically extending brake bar 120, which is secured to lift housing 28, and a cooperating air brake unit 122, which is rigidly secured to support assembly 48 and movable therewith. In accordance with a preferred form of the invention, the brake bar 120 has a vertical slot 121, formed through an upper portion thereof, to receive a shoulder bolt 123 therethrough, as seen in FIG. 5. Accordingly, the brake bar 120 is suspended in a manner which permits limited upward movement threof. Brake unit 122 is secured to support bracket 124, which in turn is secured to support assembly 48. As best seen in FIG. 3, air brake unit 122 is received about brake bar 120 and is vertically movable along the length thereof when not activated. Upon activation of the brake unit 122, the brake unit is securely clamped to brake bar 120 which precludes the vertical movement thereof relative to brake bar 120 and accordingly the vertical movement of the mechanism 12 and assembly 36.

Referring specifically to FIGS. 2 and 4, the actuator assembly 118 includes an actuator link member 126 and an actuator pivot bar 128. Actuator link member 126 is slidably received between a pair of side plates 130, which plates are secured to plough member 42. A pivot bar bumper plate 132 is received between plates 130 and secured thereto so as to cooperate with plough member 42 to create a channel to guide the vertical movement of actuator link member 126 therebetween. As will hereinbelow become more apparent, link member 126 is movable between a raised or activating position (not shown) and a lowered or inactivating position (shown in FIGS. 2 and 4).

The vertical movement of link member 126 between its raised and lowered positions is controlled by actuator pivot bar 128. Pivot bar 128 is pivotally secured at an intermediate portion thereof to the lower end of link member 126. As best seen in FIG. 2, pivot bar 128 is provided with a pair of ears 134 secured thereto, which receive member 126 therebetween, and a horizontal pivot pin 136 extends through ears 134 and member 126, so as to permit the pivotal movement of pivot bar 128 between a first generally horizontal position (not shown) and a second inclined position (shown in FIG. 2). In order to translate the pivotal movement of pivot bar 128 to vertical movement of link member 126, a flexible link, such as a chain 138 of preselected length, extends between and is suitably secured to one end of pivot bar 128 and to a lower portion of plate 132. It should be noted that the corner of pivot bar 128 is cut away to permit the pivotal movement of pivot bar 128. The length of chain 138 is such that as pivot bar 128 is moved from its inclined position to its horizontal position an upward force is applied to link member 126 to move it to its raised position. A spring 140 extends between an intermediate portion of link member 126 and one of the plates 130 to bias the link member 126 towards its lowered position. The positioning of ears 134 towards one end of the pivot bar 128 is effective to bias the pivot bar towards its inclined position.

The control means 116 which controls the brake assembly 114 will now be described. Control means 116 includes a limit valve 142 which is secured to support assembly 48. Valve 142 has a pivotal control lever 144 to activate and inactivate the valve and thereby respectively activate and inactivate the brake unit 122. Referring to FIG. 4, the control lever 144 is shown in its inactivated position. The control lever 144 is moved into its activated position when the outer end thereof is raised by the vertical movement of link member 126 through an actuator adjustment block assembly 146. Block assembly 146 includes a block 147 which is secured to the upper end of link member 126. A threaded rod 148 extends upwardly from block 147 into contact with control lever 144. Through adjustment of the length of rod 148 which extends above block 147 the point at which valve 142 is activated and inactivated may be adjusted.

From the foregoing description, it should be apparent that when the pivot bar 128 is in its inclined position, the brake assembly 114 is inactivated, and when the pivot bar 128 is in its horizontal position, the brake assembly 114 is activated. The discussion of the operation of the apparatus 10 which hereinbelow follows will further describe this relationship.

Referring to FIGS. 2 and 4, a limit valve 150 is controllably positioned in the frame 14 generally in vertical alignment with pivot bar 128. Valve 150 is activated and inactivated by a lever 152 pivotally mounted to frame 14. The operation of limit valve 150 will be further described with the discussion of the operation of the apparatus 10.

A carton stop assembly 160 is pivotally secured to frame 14 immediately rearward of limit valve 150. Assembly 160 includes a plate 162 which is secured to a pair of pivot arms 164 suitably secured to a pivot rod 166. Rotation of pivot rod 166 by a pneumatic cylinder (not shown) is effective to move plate 162 between its carton stop position, as shown in solid lines in FIGS. 2 and 4, and its storage position as shown in phantom lines in FIG. 2. The operation of assembly 160 will be further described with the discussion of the operation of apparatus 10.

The modus operandi of the apparatus 10 in accordance with the present invention will now be described with reference to the drawings as described above. The various alternative pneumatic circuits which may be utilized to effect the movement of the various assemblies as hereinabove described are considered to be within the knowledge of those skilled in the art. Accordingly, the specific movement of such assemblies will be described without reference to any specific pneumatic circuitry.

At the start of operation, side arms 18 and 20 are at their outermost positions and the lift assemblies 30 and 32, and the sealing head assembly 36 and flap folding mechanism 12 respectively secured thereto, are in their uppermost positions. The kicker member 100 of kicker assembly 46 is in its extended position, as shown in FIG. 2. The actuator link 126 is in its lowered or inactivated position and the pivot bar 128 is in its inclined or inactivated position, as shown in FIG. 2. Thus, the brake assembly 114 is inactivated and the brake unit 122 is free to vertically move relative to brake bar 120. The stop plate assembly 160 is in its raised position, as shown in FIG. 4.

As the carton to be sealed moves inward from infeed conveyor 38 onto rollers 16 of apparatus 10, its leading edge contacts lever 152 and activates limit valve 150. Activation of limit valve 150 is effective to activate a suitable power valve (not shown), which causes cylinder 33 to lower lift assemblies 30 and 32, and the respective assembly 36 and mechanism 12 secured thereto, towards the carton support bed defined therebelow. As the mechanism 12 is lowered into contact with the carton, the forward portion of pivot bar 128 contacts the upper edge of the leading end wall of the carton and is pivoted about pivot pin 136 to its horizontal or activated position against the bias of spring 140. The movement of pivot bar 128 into its activated position is effective to move actuator plate 126 upward into its activated position, which activates the limit valve 142 through block 148 and lever 144. Activation of limit valve 142 is effective to activate brake assembly 114 and thereby clamp air brake unit 122 to brake bar 120 so as to prevent further downward movement of the lift assemblies 30 and 32. In accordance with the present invention, the brake assembly 114 is activated at or immediately prior to the plough member 42 coming in contact with the upper edge of the leading end wall of the carton so as to prevent the application of crushing forces to the end walls of the carton. The limited vertical movement of the brake bar 120, as herein previously discussed, prevents the application of crushing forces in the instance of an over-packed carton. As the actuator plate 126 is raised to its upper position, the pivot bar 128 in its horizontal position is also raised to an elevation at, or slightly above, the elevation of the lower surface of plough member 42. The lowering operation, as just described further, infolds the leading minor flap as it contacts the pivot bar 128 and the lower surface of plough member 42. The activation of limit valve 142 is also effective to activate a suitable power valve (not shown) which controls cylinder 92, which causes the rod end thereof to retract and thereby move kicker plate 88 and kicker assembly 100 to move inwardly and infold the trailing minor flap of the carton.

Activation of limit valve 142 is also effective to control a suitable power valve (not shown) to activate the cylinder which controls the movement of the side arm 18 and 20 and the cylinder which controls the movement of the stop plate assembly 160. Accordingly, substantially simultaneous with the braking of the downward movement of the assemblies 30 and 32, the side arms 18 and 20 are moved inwardly into contact with the side walls of the carton and the carton stop assembly is moved into its storage position, which permits the movement of the carton through the apparatus 10. As the side arm assemblies move inward, the contacting arms 44, and rollers 76 associated therewith, contact and infold the major flaps of the carton.

The conveyor belts 22 and 23 of the side arm assemblies 18 and 20 remain in contact with the side walls of the carton and move the carton passed the tape head assembly 36, where a strip of sealing tape is applied across the top surfaces of the major flaps and the upper portions of the end walls. As the lower trailing edge of the carton passes over lever 152, the limit valve 150 is inactivated which starts the operation of three time delays. After the first time delay, a power valve associated with the carton stop assembly 160 and the side arm assemblies 18 and 20, is activated to cause the stop plate 162 to return to its raised position and the side arm assemblies 18 and 20 to return to their outermost positions. After the second time delay, the power valve associated with brake assembly 114 is activated to inactivate the brake unit 122 and thereby permit the brake unit to move relative to brake bar 120. After the third time delay, the power valve associated with lift cylinder 33 and the kicker cylinder 92 is activated to return the lift assemblies 30 and 32 to their uppermost positions and the kicker plate 88 and kicker assembly 100 to their outermost positions.

The foregoing is a description of a .preferred embodiment of the invention which is given here by way of example. The invention is not to be taken as limited to any specific feature as described, but comprehends all such variations thereof as come within the scope of the appended claims.

What is claimed is:

1. In combination with apparatus of the type used for sealing the foldable flaps of cartons of random sizes, said apparatus including a frame structure, a vertically movable flap folding assembly mounted to said frame structure, power means for vertically moving said flap folding assembly towards and away from a carton positioned therebelow; an improved arrangement for positioning said flap folding assembly at or immediately above the upper edges of the walls of the carton without crushing said upper edges, comprising: a brake assembly for selectively retaiing said sealing head assembly in a fixed position; a control means associated with said brake assembly which upon activation prevents the downward movement of said sealing head assembly; an actuator pivot bar pivotally mounted about a generally horizontal axis, said actuator pivot bar movable between a first generally horizontal position and a second inclined position; and an actuator link mounted for movement relative to said flap folding assembly between a first position wherein said control means is activated and a second position wherein said control means is inactivated, said actuator pivot bar being pivotally mounted to said actuator link such that as said actuator pivot bar contacts the upper edge of a carton and moves into its first position said actuator link moves into its first position and as the carton leaves the apparatus and the actuator pivot bar moves into its second position said actuator link moves into its second position, said actuator link and said actuator pivot bar are biased towards their second positions, said actuator link has an upper end which is secured to an actuator adjustment block which contacts and actuates said control means, said actuator adjustment block having a threaded shaft to adjust the activation of said control means as said actuator pivot bar attains its first position and prior to said flap folding assembly applying crushing forces to the end walls of the carton.

2. The invention as defined in claim 1 wherein said actuator link is slidably mounted so as to permit generally vertical movement thereof, said actuator link having a lower end which is secured to an intermediate portion of said actuator pivot bar through a pivotal connection, and a first end of said actuator pivot bar is connected to said sealing head assembly through a flexible connnecting member of a preselected length, such that movement of said actuator pivot bar from its second position towards its first position moves said actuator link from its first position towards its position through said pivotal connection.

3. The invention as defined in claim 2 wherein said flexible connecting member is a short length of chain.

4. The invention as defined in claim 1 wherein said actuator link is biased towards its second position by a spring means.

5. The invention as defined in claim 1 wherein said actuator pivot bar is biased towards its second position by positioning its pivotal connection towards said first end thereof.

6. In combination with apparatus of the type used for sealing the foldable flaps of cartons of random sizes, said apparatus including a frame structure, a vertically movable flap folding assembly mounted to said frame structure, power means for vertically moving said flap folding assembly towards and away from a carton positioned therebelow; and improved arrangement for positioning said flap folding assembly at or immediately above the upper edges of the walls of the carton without crushing said upper edges, comprising: a brake assembly for selectively retaining said sealing head assembly in a fixed position; a control means associated with said brake assembly which upon activation prevents the downward movement of said sealing head assembly; an actuator pivot bar pivotally mounted about a generally horizontal axis, said actuator pivot bar movable between a first generally horizontal position and a second inclined position; and an actuator link mounted for movement relative to said flap folding assembly between a first position wherein said control means is activated and a second position wherein said control means is inactivated, said actuator pivot bar being pivotally mounted to said actuator link such that as said actuator pivot bar contacts the upper edge of a carton and moves into its first position said actuator link moves into its first position and as the carton leaves the apparatus and the actuator pivot bar moves into its second position said actuator link moves into its second position, said actuator link and said actuator pivot bar are biased towards their second positions, said brake assembly includes a generally vertical brake bar secured to said frame structure and a brake unit secured to said sealing head assembly and movable therewith, said brake unit being positioned to receive said brake bar so as to selectively clamp said brake unit to said brake bar upon activation of said control means.

7. The invention as defined in claim 6 wherein said brake unit is a caliper-type air brake which surrounds said brake bar.

8. The invention as defined in claim 6 wherein said brake bar has a vertical slot formed therein and is secured to said frame structure by a fastener means passing through said vertical slot so as to permit limited vertical movement thereof.

* * * * *